US010955764B2

(12) United States Patent
Akazaki et al.

(10) Patent No.: US 10,955,764 B2
(45) Date of Patent: Mar. 23, 2021

(54) TONER FOR DEVELOPING ELECTROSTATIC IMAGES

(71) Applicant: ZEON CORPORATION, Tokyo (JP)

(72) Inventors: Kojiro Akazaki, Tokyo (JP); Junichi Takashima, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/337,515

(22) PCT Filed: Sep. 20, 2017

(86) PCT No.: PCT/JP2017/033909
§ 371 (c)(1),
(2) Date: Mar. 28, 2019

(87) PCT Pub. No.: WO2018/061933
PCT Pub. Date: Apr. 5, 2018

(65) Prior Publication Data

US 2019/0227450 A1 Jul. 25, 2019

(30) Foreign Application Priority Data

Sep. 30, 2016 (JP) ..... JP2016-194749

(51) Int. Cl.
*G03G 9/097* (2006.01)
*G03G 9/08* (2006.01)
*G03G 9/087* (2006.01)

(52) U.S. Cl.
CPC ..... *G03G 9/09791* (2013.01); *G03G 9/0819* (2013.01); *G03G 9/0821* (2013.01); *G03G 9/0827* (2013.01); *G03G 9/08711* (2013.01); *G03G 9/09725* (2013.01)

(58) Field of Classification Search
CPC .. G03G 9/0821; G03G 9/0819; G03G 9/0827; G03G 9/09791
See application file for complete search history.

(56) References Cited

U.S. PATENT DOCUMENTS 4,960,665 A * 10/1990 Elder ..... G03G 9/09725 430/108.3
6,197,468 B1 * 3/2001 Ohmura ..... G03G 9/08704 430/109.2
6,291,124 B1 * 9/2001 Ohno ..... G03G 9/0819 106/31.43
6,416,916 B1 * 7/2002 Silence ..... G03G 9/0823 430/108.3
9,958,798 B2 * 5/2018 Nakatani ..... G03G 9/0819
2003/0175043 A1 9/2003 Handa et al.
2007/0098436 A1 * 5/2007 Arakawa ..... G03G 15/0898 399/103
2008/0279595 A1 11/2008 Uezono
2011/0177444 A1 * 7/2011 Mattison, Jr. ..... G03G 9/0823 430/108.3
2014/0348551 A1 * 11/2014 Yamabe ..... G03G 15/0872 399/263
2015/0050591 A1 2/2015 Hirasawa
2015/0185644 A1 * 7/2015 Matsui ..... G03G 9/083 430/108.3

FOREIGN PATENT DOCUMENTS

JP 2003-280242 A 10/2003
JP 2008-225174 A 9/2008
JP 2008-281806 A 11/2008
JP 2014-167539 A 9/2014
JP 2014-186067 A 10/2014
WO 2013/146200 A1 10/2013
WO WO-2015147212 A1 * 10/2015 ..... G03G 9/0823

OTHER PUBLICATIONS

English language machine translation of JP 2008-225174 (Year: 2008).*
Notification of Transmittal of Translation of the International Preliminary Report on Patentabililty (Form PCT/IB/338) issued in counterpart International Application No. PCT/JP2017/033909 dated Apr. 11, 2019 with Forms PCT/IB/373 and PCT/ISA/237 (8 pages).

* cited by examiner

*Primary Examiner* — Christopher D Rodee
(74) *Attorney, Agent, or Firm* — Westerman, Hattori, Daniels & Adrian, LLP

(57) ABSTRACT

A toner which is less likely to cause toner leakage and which is less likely to cause aggregation after being left to stand under a high temperature condition. A toner for developing electrostatic images, comprising colored resin particles comprising a binder resin and a colorant, and an external additive, wherein a conditioned bulk density obtained by a powder flowability analyzing device is from 0.525 g/mL to 0.565 g/mL.

4 Claims, No Drawings

TONER FOR DEVELOPING ELECTROSTATIC IMAGES

TECHNICAL FIELD

The disclosure relates to a toner for developing electrostatic images, which is configured to be used for development in image forming devices based on electrophotography, such as a copy machine, a facsimile machine and a printer.

BACKGROUND ART

In image forming devices such as an electrophotographic device, an electrostatic recording device and an electrostatic printing device, the following image forming method is widely used and applied to copy machines, printers, facsimile machines, and multifunctional printers: an electrostatic latent image is formed on a photoconductor, and the formed image is developed with a toner for developing electrostatic images, thereby forming a desired image.

For example, in an electrophotographic device based on electrophotography, generally, the surface of a photoconductor composed of a photoconductive substance, is uniformly charged by various methods; an electrostatic latent image is formed on the photoconductor; the electrostatic latent image is developed with a toner; and a toner image is transferred to a recording medium such as a paper sheet and fixed by heating, etc., thereby obtaining a copy.

In recent years, there is a strong demand for electrophotographic devices that can produce high quality images and adapt to high speed printing. Along with this, there are diversified needs for toners. Especially, there is a strong need for prevention of so-called toner leakage, which is a defect that toner leaks mainly from a sealing part of a developing device, and which interferes with continuous printing and leads to toner loss.

As a technique for preventing toner leakage, for example, Patent Document 1 discloses the use of a toner having an apparent loose density of from 0.310 g/ml to 0.410 g/ml and a volume average particle diameter of from 5.00 μm to 10.00 μm in a developing unit including a powder seal mechanism. In Patent Document 1, it is described that the flowability and so on of the toner can be controlled by setting the apparent loose density and volume average particle diameter of the toner within the above ranges.

As another technique for preventing toner leakage, for example, Patent Document 2 discloses a cleaning device comprising: a predetermined cleaning member for removal of toner from the surface of a cleaning target body; a frame body forming a storage room for storing the removed toner; and a predetermined sealing structure sealing between the cleaning member and the frame body to prevent toner leakage from the storage room.

However, in Patent Document 1, there is almost no description of the method for controlling the apparent loose density. Therefore, no insight can be obtained from Patent Document 1, which is practical to prevent toner leakage in light of toner properties. The technique disclosed in Patent Document 2 does not contribute to an improvement in toner properties.

CITATION LIST

Patent Document 1: Japanese Patent Application Laid-Open (JP-A) No. 2014-186067

Patent Document 2: JP-A No. 2014-167539

SUMMARY OF INVENTION

Technical Problem

An object of the disclosed embodiments is to provide a toner which is less likely to cause toner leakage and which is less likely to cause aggregation after being left to stand under a high temperature condition.

Solution to Problem

The inventors of the present invention found that the above-mentioned problem can be solved by setting the conditioned bulk density obtained by a powder flowability analyzing device in a specific range.

The toner for developing electrostatic images according to the disclosed embodiments, is a toner for developing electrostatic images, comprising colored resin particles comprising a binder resin and a colorant, and an external additive, wherein a conditioned bulk density obtained by a powder flowability analyzing device is from 0.525 g/mL to 0.565 g/mL.

In the disclosed embodiments, a BET specific surface area of the toner for developing electrostatic images is preferably from 1.50 $m^2/g$ to 1.90 $m^2/g$.

In the disclosed embodiments, an average circularity of the toner for developing electrostatic images is preferably from 0.96 to 1.00.

In the disclosed embodiments, a volume average particle diameter (Dv) of the colored resin particles is preferably from 4 μm to 12 μm.

Advantageous Effects of Invention

According to the disclosed embodiments, the toner for developing electrostatic images which is less likely to cause toner leakage and which is less likely to cause aggregation after being left to stand under a high temperature condition, is provided by setting the conditioned bulk density within the specific range.

DESCRIPTION OF EMBODIMENTS

The toner for developing electrostatic images according to the disclosed embodiments, is a toner for developing electrostatic images, comprising colored resin particles comprising a binder resin and a colorant, and an external additive, wherein a conditioned bulk density (hereinafter may be referred to as CBD) obtained by a powder flowability analyzing device is from 0.525 g/mL to 0.565 g/mL.

Hereinafter, the toner for developing electrostatic images of the disclosed embodiments (hereinafter it may be simply referred to as "toner") will be described.

The toner of the disclosed embodiments comprises colored resin particles comprising a binder resin and a colorant, and an external additive.

Hereinafter, a colored resin particle production method used in the disclosed embodiments, colored resin particles obtained by the production method, a toner production method of the disclosed embodiments using the colored resin particles, and the toner of the disclosed embodiments, will be described in order.

1. Method for Producing Colored Resin Particles

In general, methods for producing colored resin particles are broadly classified into dry methods such as a pulverization method and wet methods such as an emulsion polymerization agglomeration method, a suspension polymerization method and a solution suspension method. The wet methods are preferred since a toner that has excellent printing properties such as image reproducibility, can be easily obtained. Among the wet methods, polymerization methods such as the emulsion polymerization agglomeration method and the suspension polymerization method are preferred, since a toner that has relatively small particle size distribution in micron order, can be easily obtained. Among the polymerization methods, the suspension polymerization method is more preferred.

The emulsion polymerization agglomeration method is a method for producing colored resin particles by polymerizing emulsified polymerizable monomers to obtain a resin microparticle emulsion, and aggregating the resulting resin microparticles with a colorant dispersion, etc. The solution suspension method is a method for producing colored resin particles by forming a solution into droplets in an aqueous medium, the solution containing toner components dissolved or dispersed in an organic solvent, such as a binder resin and a colorant, and removing the organic solvent. Both methods can be carried out by known methods.

The colored resin particles of the disclosed embodiments can be produced by the wet methods or the dry methods. Among the wet methods, the suspension polymerization method is preferred. By the suspension polymerization method, the colored resin particles are produced through the processes described below.

(A) Suspension Polymerization Method (A-1) Process of Preparing Polymerizable Monomer Composition First, a polymerizable monomer, a colorant and, as needed, other additive(s) such as a charge control agent, are mixed to prepare a polymerizable monomer composition. In the preparation of the polymerizable monomer composition, the mixing is conducted by a media type dispersing machine, for example.

In the disclosed embodiments, "polymerizable monomer" means a monomer having a polymerizable functional group, and the polymerizable monomer is polymerized into a binder resin. A monovinyl monomer is preferably used as a main component of the polymerizable monomer. Examples of monovinyl monomers include the following: styrene; styrene derivatives such as vinyl toluene and α-methylstyrene; acrylic acids and methacrylic acids; acrylic esters such as methyl acrylate, ethyl acrylate, propyl acrylate, butyl acrylate, 2-ethylhexyl acrylate and dimethylaminoethyl acrylate; methacrylic esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers can be used alone or in combination of two or more kinds. Of these monovinyl monomers, preferably used are styrene, styrene derivatives, acrylic esters and methacrylic esters.

To prevent hot offset and improve storage stability, it is preferable to use the monovinyl monomer and an optional cross-linkable polymerizable monomer. The cross-linkable polymerizable monomer means a monomer having two or more polymerizable functional groups. Examples of cross-linkable polymerizable monomers include aromatic divinyl compounds such as divinylbenzene, divinylnaphthalene and derivatives thereof; ester compounds such as ethylene glycol dimethacrylate and diethylene glycol dimethacrylate, in which two or more carboxylic acids having a carbon-carbon double bond are esterified to an alcohol having two or more hydroxyl groups; other divinyl compounds such as N,N-divinylaniline and divinyl ether; and compounds having three or more vinyl groups. These cross-linkable polymerizable monomers can be used alone or in combination of two or more kinds.

In the disclosed embodiments, the cross-linkable polymerizable monomer is used in an amount of generally from 0.1 part by mass to 5 parts by mass, and preferably from 0.3 part by mass to 2 parts by mass, with respect to 100 parts by mass of the monovinyl monomer.

In addition, as a part of the polymerizable monomer, it is also preferable to use a macromonomer. This is because the toner thus obtained has an excellent balance between storage stability and low-temperature fixability. A macromonomer is one having a polymerizable carbon-carbon unsaturated double bond at an end of a molecular chain thereof, and it is also a reactive oligomer or polymer generally having a number average molecular weight of 1,000 to 30,000. The macromonomer is preferably one that gives a polymer having a higher glass transition temperature (hereinafter may be referred to as "Tg") than that of the polymer obtained by polymerizing the above-mentioned monovinyl monomer. The macromonomer is used in an amount of preferably from 0.03 part by mass to 5 parts by mass, and more preferably from 0.05 part by mass to 1 part by mass, with respect to 100 parts by mass of the monovinyl monomer.

As the macromonomer, examples include a polyacrylic acid ester macromonomer, a polymethacrylic acid ester macromonomer, a polystyrene macromonomer, a polyacrylonitrile macromonomer, a silicone macromonomer, copolymers of these macromonomers, etc. Of them, preferred are a polyacrylic acid ester macromonomer and a polymethacrylic acid ester macromonomer.

A colorant is used in the disclosed embodiments. In the case of producing a color toner, black, cyan, yellow and magenta colorants can be used.

As the black colorant, for example, carbon black, titanium black, and magnetic powders of zinc iron oxide, nickel iron oxide and so on can be used.

As the cyan colorant, for example, dyes and pigments such as copper phthalocyanine compounds, derivatives thereof, and anthraquinone compounds can be used. Examples thereof include C.I. Pigment Blue 2, 3, 6, 15, 15:1, 15:2, 15:3, 15:4, 16, 17:1, 60 and so on.

As the yellow colorant, for example, compounds including dyes, condensed polycyclic pigments and azo-based pigments such as monoazo pigments and disazo pigments, are used. Examples thereof include C.I. Pigment Yellow 3, 12, 13, 14, 15, 17, 62, 65, 73, 74, 83, 93, 97, 120, 138, 155, 180, 181, 185, 186, 213 and 214.

As the magenta colorant, compounds including dyes, condensed polycyclic pigments and azo-based pigments such as monoazo pigments and disazo pigments, are used. Examples thereof include C.I. Pigment Violet 19 and C.I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269.

In the disclosed embodiments, these colorants can be used alone or in combination of two or more kinds. The amount of the colorant is preferably from 1 part by mass to 10 parts by mass, with respect to 100 parts by mass of the monovinyl monomer.

From the viewpoint of improving the releasing property of the toner from a fixing roller upon fixing, it is preferable to add a release agent to the polymerizable monomer composition. The release agent is not particularly limited, as long as it is one that is generally used as a release agent in toners.

The release agent preferably contains at least one of an ester wax and a hydrocarbon wax. It is more preferable to use both of them as the release agent. By using these waxes as the release agent, a suitable balance between low-temperature fixability and storage stability can be obtained.

In the disclosed embodiments, a polyfunctional ester wax is preferably used as the release agent. Examples thereof include pentaerythritol ester compounds such as pentaerythritol tetrapalmitate, pentaerythritol tetrabehenate and pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate, and glycerin tribehenate; and dipentaerythritol ester compounds such as dipentaerythritol hexamyristate and dipentaerythritol hexapalmitate. Of them, preferred are glycerin ester compounds, and more preferred are hexaglycerin esters.

Also in the disclosed embodiments, a hydrocarbon wax is preferably used as the release agent. Examples thereof include synthetic waxes such as a polyethylene wax, a polypropylene wax and a Fischer-Tropsch wax, and petroleum waxes such as a paraffin wax and a microcrystalline wax. Of them, preferred are a Fischer-Tropsch wax and a petroleum wax; more preferred is a petroleum wax; and still more preferred is a paraffin wax.

The hydrocarbon wax has a number average molecular weight of preferably from 300 to 800, and more preferably from 400 to 600. The hydrocarbon wax has a penetration of preferably from 1 to 10, and more preferably from 2 to 7, which is measured according to JIS K2235 5.4.

Besides the above release agents, for example, a natural wax such as jojoba and a mineral wax such as ozokerite can be used.

As the release agent, the above-mentioned waxes are preferably used alone or in combination of two or more kinds.

The release agent is used in an amount of preferably from 0.1 part by mass to 30 parts by mass, and more preferably from 1 part by mass to 20 parts by mass, with respect to 100 parts by mass of the monovinyl monomer.

As another additive, a positively or negatively chargeable charge control agent can be used to improve the chargeability of the toner.

The charge control agent is not particularly limited, as long as it is one that is generally used as a charge control agent for toners. Among charge control agents, a positively or negatively chargeable charge control resin is preferred, since the charge control resin is highly compatible with the polymerizable monomer and can impart stable chargeability (charge stability) to the toner particles. From the viewpoint of obtaining a positively chargeable toner, a positively chargeable charge control resin is more preferred. The toner of the disclosed embodiments is preferably a positively chargeable toner.

As the positively chargeable charge control agent, examples include a nigrosine dye, a quaternary ammonium salt, a triaminotriphenylmethane compound, an imidazole compound, and, as a charge control resin preferably used as the positively chargeable charge control agent, a polyamine resin, a quaternary ammonium-containing copolymer and a quaternary ammonium salt-containing copolymer.

As the negatively chargeable charge control agent, examples include an azo dye containing a metal such as Cr, Co, Al and Fe, a metal salicylate compound, a metal alkylsalicylate compound, and, as a charge control resin preferably used as the negatively chargeable charge control agent, a sulfonic acid-containing copolymer, a sulfonic acid salt-containing copolymer, a carboxylic acid-containing copolymer and a carboxylic acid salt-containing copolymer.

In the disclosed embodiments, it is desirable that the charge control agent is used in an amount of generally from 0.01 part by mass to 10 parts by mass, and preferably from 0.03 part by mass to 8 parts by mass, with respect to 100 parts by mass of the monovinyl monomer. When the added amount of the charge control agent is less than 0.01 part by mass, fog may occur. On the other hand, when the added amount of the charge control agent is more than 10 parts by mass, soiling may occur.

As another additive, a molecular weight modifier is preferably used in the polymerization of the polymerizable monomer that is polymerized into a binder resin.

The molecular weight modifier is not particularly limited, as long as it is one that is generally used as a molecular weight modifier for toners. As the molecular weight modifier, examples include mercaptans such as t-dodecyl mercaptan, n-dodecyl mercaptan, n-octyl mercaptan and 2,2,4,6,6-pentamethylheptane-4-thiol, and thiuram disulfides such as tetramethyl thiuram disulfide, tetraethyl thiuram disulfide, tetrabutyl thiuram disulfide, N,N'-dimethyl-N,N'-diphenyl thiuram disulfide, and N,N'-dioctadecyl-N,N'-diisopropyl thiuram disulfide. These molecular weight modifiers may be used alone or in combination of two or more kinds.

In the disclosed embodiments, it is desirable that the molecular weight modifier is used in an amount of generally from 0.01 part by mass to 10 parts by mass, and preferably from 0.1 part by mass to 5 parts by mass, with respect to 100 parts by mass of the monovinyl monomer.

(A-2) Suspension Process of Obtaining Suspension (Droplets Forming Process)

In the disclosed embodiments, the polymerizable monomer composition containing at least the polymerizable monomer and the colorant, is dispersed in an aqueous medium containing a dispersion stabilizer, and a polymerization initiator is added therein. Then, the polymerizable monomer composition is formed into droplets. The method for forming the droplets is not particularly limited. For example, the droplets are formed by means of a device capable of strong stirring, such as an (in-line type) emulsifying and dispersing machine (product name: MILDER, manufactured by: Pacific Machinery & Engineering Co., Ltd.) and a high-speed emulsifying and dispersing machine (product name: T. K. HOMOMIXER MARK II, manufactured by: PRIMIX Corporation).

As the polymerization initiator, examples include persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxy diethylacetate, t-hexylperoxy-2-ethylbutanoate, diisopropylperoxydicarbonate, di-t-butylperoxyisophthalate and t-butylperoxyisobutyrate. They can be used alone or in combination of two or more kinds. Among them, organic peroxides are preferred since they can reduce residual polymerizable monomer and impart excellent printing durability.

Among organic peroxides, preferred are peroxy esters, and more preferred are non-aromatic peroxy esters, i.e., peroxy esters not having an aromatic ring, since they have excellent initiator efficiency and can reduce residual polymerizable monomer.

As described above, the polymerization initiator may be added after the polymerizable monomer composition is dispersed into the aqueous medium and before the polymerizable monomer composition is formed into droplets, or it may be added to the polymerizable monomer composition before the polymerizable monomer composition is dispersed into the aqueous medium.

The added amount of the polymerization initiator used for the polymerization of the polymerizable monomer composition, is preferably from 0.1 part by mass to 20 parts by mass, more preferably from 0.3 part by mass to 15 parts by mass, and still more preferably from 1 part by mass to 10 parts by mass, with respect to 100 parts by mass of the monovinyl monomer.

In the disclosed embodiments, the aqueous medium means a medium containing water as a main component.

In the disclosed embodiments, the dispersion stabilizer is preferably added to the aqueous medium. As the dispersion stabilizer, examples include inorganic compounds including sulfates such as barium sulfate and calcium sulfate, carbonates such as barium carbonate, calcium carbonate and magnesium carbonate, phosphates such as calcium phosphate, metal oxides such as aluminum oxide and titanium oxide, and metal hydroxides such as aluminum hydroxide, magnesium hydroxide and iron(II) hydroxide, and organic compounds including water-soluble polymers such as polyvinyl alcohol, methyl cellulose and gelatin, anionic surfactants, nonionic surfactants, and ampholytic surfactants. These dispersion stabilizers can be used alone or in combination of two or more kinds.

Among the above dispersion stabilizers, preferred are colloids of inorganic compounds, and particularly preferred is a colloid of a hardly water-soluble metal hydroxide. By using a colloid of an inorganic compound, particularly a colloid of a hardly water-soluble metal hydroxide, the colored resin particles can have a narrow particle size distribution, and the amount of the dispersion stabilizer remaining after washing can be small, so that the toner thus obtained can clearly reproduce an image and have excellent environmental stability.

(A-3) Polymerization Process

Formation of the droplets is carried out as described under the above (A-2). The thus-obtained aqueous dispersion medium is heated to polymerize, thereby forming an aqueous dispersion containing the colored resin particles.

The polymerization temperature of the polymerizable monomer composition is preferably 50° C. or more, and more preferably from 60° C. to 95° C. The polymerization reaction time is preferably from 1 hour to 20 hours, and more preferably from 2 hours to 15 hours.

The colored resin particles may be mixed as they are with an external additive and used as a polymerized toner. It is preferable that the colored resin particles are so-called core-shell type (or "capsule type") colored resin particles obtained by using the colored resin particles as a core layer and forming a shell layer, which is different from the core layer, around the core layer. By covering the core layer composed of a substance having a low softening point with a substance having a higher softening point, the core-shell type colored resin particles can achieve a balance between lowering of fixing temperature and prevention of aggregation during storage.

A method for producing the above-mentioned core-shell type colored resin particles using the colored resin particles, is not particularly limited. The core-shell type colored resin particles can be produced by a conventional method. The in situ polymerization method and the phase separation method are preferred from the viewpoint of production efficiency.

Hereinafter, the method for producing the core-shell type colored resin particles by the in situ polymerization method, will be described.

The core-shell type colored resin particles can be obtained by adding a polymerizable monomer for forming a shell layer (a polymerizable monomer for shell) and a polymerization initiator to an aqueous medium in which the colored resin particles are dispersed, and then polymerizing the mixture.

As the polymerizable monomer for shell, the above-mentioned polymerizable monomers can be used. Among the polymerizable monomers, it is preferable to use monomers that can provide a polymer having a Tg of more than 80° C., such as styrene, acrylonitrile and methyl methacrylate, alone or in combination of two or more kinds.

As the polymerization initiator used for polymerization of the polymerizable monomer for shell, examples include water-soluble polymerization initiators including metal persulfates such as potassium persulfate and ammonium persulfate, and azo-type initiators such as 2,2'-azobis(2-methyl-N-(2-hydroxyethyl)propionamide) and 2,2'-azobis(2-methyl-N-(1,1-bis(hydroxymethyl)2-hydroxyethyl) propionamide). These polymerization initiators can be used alone or in combination of two or more kinds. The amount of the polymerization initiator is preferably from 0.1 part by mass to 30 parts by mass, and more preferably from 1 part by mass to 20 parts by mass, with respect to 100 parts by mass of the polymerizable monomer for shell.

The polymerization temperature of the shell layer is preferably 50° C. or more, and more preferably from 60° C. to 95° C. The polymerization reaction time is preferably from 1 hour to 20 hours, and more preferably from 2 hours to 15 hours.

(A-4) Washing, Filtering, Dehydrating and Drying Processes

After the polymerization is completed, the aqueous dispersion of the colored resin particles obtained by the polymerization is preferably subjected to operations of filtering, washing for removal of the dispersion stabilizer, dehydrating and drying, several times as needed, according to a conventional method.

The washing is preferably carried out by the following method. When the inorganic compound is used as the dispersion stabilizer, it is preferable that the dispersion stabilizer is dissolved in water and removed by adding acid or alkali to the aqueous dispersion of the colored resin particles. When the colloid of the hardly water-soluble inorganic hydroxide is used as the dispersion stabilizer, it is preferable that the pH of the aqueous dispersion of the colored resin particles is controlled to 6.5 or less by adding acid. As the acid, examples include inorganic acids such as sulfuric acid, hydrochloric acid and nitric acid, and organic acids such as formic acid and acetic acid. Sulfuric acid is particularly preferred for its high removal efficiency and small impact on production facilities.

The dehydrating and filtering method is not particularly limited and can be selected from various known methods. As the method, examples include a centrifugal filtration method, a vacuum filtration method and a pressure filtration method. Also, the drying method is not particularly limited and can be selected from various methods.

(B) Pulverization Method

In the case of producing the colored resin particles by employing the pulverization method, the colored resin particles are produced by the following processes.

First, a binder resin, a colorant, and other additives added as needed, such as a charge control agent, are mixed by means of a ball mill, a V-type mixer, HENSCHEL MIXER (product name), a high-speed dissolver or an internal mixer, for example. Next, while heating the thus-obtained mixture, the mixture is kneaded by means of a press kneader, a twin screw kneading machine, a roller or the like. The thus-obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into a desired particle diameter by means of a classifier such as a wind classifier or an airflow classifier, thereby obtaining the colored resin particles produced by the pulverization method.

In the pulverization method, those that are provided above under "(A) Suspension polymerization method" can be used as the binder resin, the colorant, and the other additives added as needed, such as the charge control agent. Similarly to the colored resin particles obtained by the above "(A) Suspension polymerization method", the colored resin particles obtained by the pulverization method can be core-shell type colored resin particles by a method such as the in situ polymerization method.

As the binder resin, resins that have been widely used in toners can be also used. As the binder resin used in the pulverization method, examples include polystyrene, styrene-butyl acrylate copolymers, polyester resins and epoxy resins.

2. Colored Resin Particles

The colored resin particles are obtained by the production method such as the above-mentioned "(A) Suspension polymerization method" or "(B) Pulverization method".

Hereinafter, the colored resin particles composing the toner will be described. The colored resin particles described below encompass both core-shell type colored resin particles and colored resin particles of other types.

The volume average particle diameter (Dv) of the colored resin particles is preferably from 4 μm to 12 μm, more preferably from 5 μm to 10 μm, still more preferably from 6 μm to 9 μm, and particularly preferably from 6.5 μm to 8.0 μm. When the volume average particle diameter (Dv) is less than 4 μm, the flowability of the toner decreases and may deteriorate transferability or decrease image density. Also when the volume average particle diameter (Dv) is less than 4 μm, toner leakage is likely to occur since the CBD is too small or the toner easily enters a gap or the like in the sealing part of the developing device. When the volume average particle diameter (Dv) is more than 12 μm, image resolution may decrease.

For the colored resin particles, the ratio (Dv/Dn) of the volume average particle diameter (Dv) and the number average particle diameter (Dn) is preferably from 1.00 to 1.30, more preferably from 1.00 to 1.20, and still more preferably from 1.00 to 1.10. When the ratio Dv/Dn is more than 1.30, the CBD may be too small, or there may be a decrease in transferability, image density and resolution. The volume average particle diameter and number average particle diameter of the colored resin particles can be measured by means of a particle size analyzer (product name: MULTISIZER, manufactured by: Beckman Coulter, Inc.), for example.

The average circularity of the colored resin particles of the disclosed embodiments, is preferably from 0.96 to 1.00, more preferably from 0.97 to 1.00, and still more preferably from 0.98 to 1.00, from the viewpoint of image reproducibility.

When the average circularity of the colored resin particles is less than 0.96, thin line reproducibility in printing may deteriorate, and the CBD value may be less than 0.525 g/mL.

In the disclosed embodiments, "circularity" is defined as a value obtained by dividing the perimeter of a circle having the same area as the projected area of a particle image, by the perimeter of the particle image. Also in the disclosed embodiments, "average circularity" is used as a simple method for quantitatively representing the shape of the particles and is an indicator that shows the degree of the surface roughness of the colored resin particles. The average circularity is 1 when the colored resin particles are perfectly spherical, and it gets smaller as the surface shape of the colored resin particles becomes more complex.

3. Method for Producing Toner

In the disclosed embodiments, as an external addition treatment, the colored resin particles are mixed and stirred with the external additive to add the external additive on the surface of the colored resin particles, thereby obtaining a one-component toner (developer). The one-component toner may be mixed and stirred with carrier particles to obtain a two-component developer.

The CBD is influenced by the degree of attachment of the external additive to the colored resin particles, for example. The influencing factors include the type of the external additive and the condition of the external addition treatment (such as peripheral speed of stirring blades and external addition treatment time), for example.

In the disclosed embodiments, as the external additive, the toner preferably contains inorganic fine particles A having a number average primary particle diameter of from 36 nm to 100 nm.

When the number average primary particle diameter of the inorganic fine particles A is less than 36 nm, the CBD value tends to be too large. As a result, a decrease in spacer effect occurs and may have an adverse effect on printing performance (e.g., fog). On the other hand, when the number average primary particle diameter of the inorganic fine particles A is more than 100 nm, the CBD value tends to be too small. As a result, the inorganic fine particles A are likely to be released from the surface of the toner particles, so that the function of the inorganic fine particles A as the external additive decreases and may have an adverse effect on printing performance.

The number average primary particle diameter of the inorganic fine particles A is more preferably from 40 nm to nm, and still more preferably from 45 nm to 70 nm. Also, the inorganic fine particles A may be hydrophobized particles.

The content of the inorganic fine particles A is preferably from 0.1 part by mass to 2.5 parts by mass, more preferably from 0.3 part by mass to 2.0 parts by mass, and still more preferably from 0.5 part by mass to 1.5 parts by mass, with respect to 100 parts by mass of the colored resin particles.

When the content of the inorganic fine particles A is less than 0.1 part by mass, the inorganic fine particles A cannot sufficiently function as the external additive and may have an adverse effect on printing performance and storage stability. On the other hand, when the content of the inorganic fine particles A is more than 2.5 parts by mass, the inorganic fine particles A are likely to be released from the surface of the toner particles, so that the function of the inorganic fine particles A as the external additive decreases and may have an adverse effect on printing performance.

In the disclosed embodiments, as the external additive, the toner preferably contains inorganic fine particles B having a number average primary particle diameter of from 15 nm to 35 nm.

When the number average primary particle diameter of the inorganic fine particles B is less than 15 nm, the CBD value tends to be too large. As a result, the inorganic fine particles B easily penetrate from the surface of the colored resin particles to the inside of the colored resin particles, cannot impart sufficient flowability to the toner particles, and may have an adverse effect on printing performance. On the other hand, when the number average primary particle diameter of the inorganic fine particles B is more than 35 nm, the CBD value tends to be too small. As a result, the proportion of the inorganic fine particles B to the surface of the toner particles (the surface coverage) decreases, and there is a possibility that sufficient flowability is not imparted to the toner particles, therefore.

The number average primary particle diameter of the inorganic fine particles B is more preferably from 17 nm to 30 nm, and still more preferably from 20 nm to 25 nm. Also, the inorganic fine particles B may be hydrophobized particles.

The content of the inorganic fine particles B is preferably from 0.1 part by mass to 2.0 parts by mass, more preferably from 0.2 part by mass to 1.5 parts by mass, and still more preferably from 0.3 part by mass to 1.0 part by mass, with respect to 100 parts by mass of the colored resin particles.

When the content of the inorganic fine particles B is less than 0.1 part by mass, the inorganic fine particles B cannot sufficiently function as the external additive and may decrease flowability or may decrease storage stability or durability. On the other hand, when the content of the inorganic fine particles B is more than 2.0 parts by mass, the inorganic fine particles B are likely to be released from the surface of the toner particles, so that a decrease in charge property may occur in a high temperature and high humidity environment and may cause fog.

In the disclosed embodiments, as the external additive, the toner preferably contains inorganic fine particles C having a number average primary particle diameter of from 6 nm to 14 nm.

When the number average primary particle diameter of the inorganic fine particles C is less than 6 nm, the CBD value tends to be too large. As a result, the inorganic fine particles C easily penetrate from the surface of the colored resin particles to the inside of the colored resin particles, cannot impart sufficient flowability to the toner particles, and may have an adverse effect on printing performance. On the other hand, when the number average primary particle diameter of the inorganic fine particles C is more than 14 nm, the CBD value tends to be too small. As a result, the proportion of the inorganic fine particles C to the surface of the toner particles (the surface coverage) decreases, and there is a possibility that sufficient flowability is not imparted to the toner particles, therefore.

The number average primary particle diameter of the inorganic fine particles C is more preferably from 6.5 nm to 12 nm, and still more preferably from 7 nm to 10 nm. Also, the inorganic fine particles C may be hydrophobized particles.

The content of the inorganic fine particles C is preferably from 0.05 part by mass to 2.0 parts by mass, more preferably from 0.1 part by mass to 1.5 parts by mass, and still more preferably from 0.2 part by mass to 1.0 part by mass, with respect to 100 parts by mass of the colored resin particles.

When the content of the inorganic fine particles C is less than 0.05 part by mass, the inorganic fine particles C cannot sufficiently function as the external additive and may decrease flowability or may decrease storage stability. On the other hand, when the content of the inorganic fine particles C is more than 2.0 parts by mass, the inorganic fine particles C are likely to be released from the surface of the toner particles, so that a decrease in charge property may occur in a high temperature and high humidity environment and may cause fog.

The toner of the disclosed embodiments preferably contains any one of the inorganic fine particles A to C, more preferably contains any two of them, and still more preferably contains all of them. By containing all of the inorganic fine particles A to C and appropriately controlling the particle diameters and amounts of the added inorganic fine particles A to C, the toner of the disclosed embodiments is prepared so that the CBD value is in the specific range.

As the inorganic fine particles A to C, examples include silica, titanium oxide, aluminum oxide, zinc oxide, tin oxide, calcium carbonate, calcium phosphate, cerium oxide and so on. The inorganic fine particles A to C may be composed of different materials. However, it is preferable that they are composed of the same material. It is preferable that all of the inorganic fine particles A to C contain silica and/or titanium oxide, and it is more preferable that all of the inorganic fine particles A to C are composed of silica.

Various kinds of commercially-available silica fine particles can be used as the inorganic fine particles A, such as VPNA50H (product name, manufactured by: Nippon Aerosil Co., Ltd., number average primary particle diameter: 40 nm) and H05TA (product name, manufactured by: Clariant Corporation, number average primary particle diameter: 50 nm).

Various kinds of commercially-available silica fine particles can be used as the inorganic fine particles B, such as NA50Y (product name, manufactured by: Nippon Aerosil Co., Ltd., number average primary particle diameter: 35 nm), MSP-012 (product name, manufactured by: Tayca Corporation, number average primary particle diameter: 16 nm) and TG-7120 (product name, manufactured by: Cabot Corporation, number average primary particle diameter: 20 nm).

Various kinds of commercially-available silica fine particles can be used as the inorganic fine particles C, such as HDK2150 (product name, manufactured by: Clariant Corporation, number average primary particle diameter: 12 nm), R504 (product name, manufactured by: Nippon Aerosil Co., Ltd., number average primary particle diameter: 12 nm), RA200HS (product name, manufactured by Nippon Aerosil Co., Ltd., number average primary particle diameter: 12 nm), MSP-013 (product name, manufactured by: Tayca Corporation, number average primary particle diameter: 12 nm) and TG-820F (product name, manufactured by: Cabot Corporation, number average primary particle diameter: 7 nm).

It is more preferable that in addition to the inorganic fine particles A to C, the toner further contains organic fine particles D having a number average primary particle diameter of from 0.3 μm to 2.0 μm, as the external additive.

When the number average primary particle diameter of the organic fine particles D is within the range, filming on a photoconductor is less likely to occur, and the toner particles are provided with stable charge property over time, so that such a toner is obtained, that deterioration in image quality (e.g., fog) is less likely to occur even after continuous printing is carried out on many sheets, and deterioration in image quality is less likely to occur especially even under a high temperature and high humidity environment (HH environment).

The number average primary particle diameter of the organic fine particles D is more preferably from 0.4 μm to 1.5 μm, and still more preferably from 0.5 μm to 1.0 μm.

The content of the organic fine particles D is preferably from 0.05 part by mass to 2.0 parts by mass, more preferably from 0.07 part by mass to 1.5 parts by mass, and still more preferably from 0.1 part by mass to 1.2 parts by mass, with respect to 100 parts by mass of the colored resin particles.

When the content of the organic fine particles D is less than 0.05 part by mass, the organic fine particles D cannot sufficiently function as the external additive, and a decrease in charge property may occur in a high temperature and high humidity environment and may cause fog. On the other hand, when the content of the organic fine particles D is more than 2.0 parts by mass, the organic fine particles D are likely to be released from the surface of the toner particles and may decrease flowability.

As the organic fine particles D, fatty acid metal salt particles are preferably used.

The fatty acid (R—COOH) corresponding to the fatty acid moiety (R—$COO^-$) of the fatty acid metal salt particles encompasses, of carboxylic acids (R—COOH) having one carboxyl group (—COOH), those having a chain structure. In the disclosed embodiments, the fatty acid moiety is preferably one derived from a higher fatty acid in which the alkyl group (R—) has many carbon atoms.

As the higher fatty acid, examples include lauric acid ($CH_3(CH_2)_{10}COOH$), tridecanoic acid ($CH_3(CH_2)_{11}COOH$), myristic acid ($CH_3(CH_2)_{12}COOH$), pentadecanoic acid ($CH_3(CH_2)_{13}COOH$), palmitic acid ($CH_3(CH_2)_{14}COOH$), heptadecanoic acid ($CH_3(CH_2)_{15}COOH$), stearic acid ($CH_3(CH_2)_{16}COOH$), arachidic acid ($CH_3(CH_2)_{18}COOH$), behenic acid ($CH_3(CH_2)_{20}COOH$), lignoceric acid ($CH_3(CH_2)_{22}COOH$) and so on. The alkyl group of the fatty acid preferably has 12 to 24 carbon atoms, more preferably 14 to 22 carbon atoms, and still more preferably 16 to 20 carbon atoms. These fatty acids composing the fatty acid metal salt particles may be used alone or in combination of two or more kinds. From the viewpoint of obtaining a uniform toner property, the fatty acids are preferably used alone.

As the metal composing the fatty acid metal salt, examples include Li, Na, K, Rb, Cs, Be, Mg, Ca, Sr, Ba, Zn and so on. Of them, Mg or Zn is preferably used.

As the organic fine particles D, various kinds of commercially-available products can be used. As the products, examples include SPZ-100F (product name, zinc stearate manufactured by: Sakai Chemical Industry Co., Ltd., number average primary particle diameter: 0.5 μm), SPX-100F (product name, magnesium stearate manufactured by: Sakai Chemical Industry Co., Ltd., number average primary particle diameter: 0.72 μm) and so on.

A stirrer is used in the external addition treatment. The stirrer is not particularly limited, as long as it is a stirring device that can add the external additive on the surface of the colored resin particles. For example, the external addition treatment can be carried out by means of a stirrer that is capable of mixing and stirring, such as HENSCHEL MIXER (product name, manufactured by: Mitsui Mining Co., Ltd.), FM MIXER (product name, manufactured by: Nippon Coke & Engineering Co., Ltd.), SUPER MIXER (product name, manufactured by: Kawata Manufacturing Co., Ltd.), Q MIXER (product name, manufactured by: Nippon Coke & Engineering Co., Ltd.), MECHANOFUSION SYSTEM (product name, manufactured by: Hosokawa Micron Corporation) and MECHANOMILL (product name, manufactured by: Okada Seiko Co., Ltd.)

The number average primary particle diameter of the external additive particles used in the disclosed embodiments, can be measured as follows. First, for each of the particles of the external additive, the particle diameter is measured by a transmission electron microscope (TEM) or the like. The particle diameters of at least 200 external additive particles are measured in this manner, and the average is defined as the number average primary particle diameter of the particles.

The amount of the external additive used can be also defined by the coverage of the external additive. The coverage of the external additive means the proportion of the surface of the colored resin particles which is covered with the external additive. The coverage is represented by the following formula (A):

$$\text{Coverage (\%)} = \frac{\sqrt{3}\, D_N \rho_N X}{2\pi \frac{D_a}{1000} \rho_a} \qquad \text{Formula (A)}$$

where $D_N$ is the particle diameter (μm) of the colored resin particles; $\rho_N$ is the density of the colored resin particles; $D_a$ is the particle diameter (nm) of the external additive; $\rho_a$ is the density of the external additive; and X is the content (% by mass) of the external additive.

When the toner contains two or more kinds of external additives, first, the coverage of each external additive is calculated, and the total of the coverages of the external additives is defined as the coverage of the external additive of the toner.

The coverage of the external additive is preferably from 50% to 150%, more preferably from 55% to 120%, and still more preferably from 65% to 95%.

As will be shown in the below-described "Examples", the CBD can be controlled by changing the peripheral speed condition of stirring blades, the external addition treatment time, etc. For example, as the peripheral speed of stirring blades or the external addition treatment time increases, there is a tendency that the CBD increases and can reduce the possibility of toner leakage. On the other hand, as the peripheral speed of stirring blades or the external addition treatment time decreases, there is a tendency that the CBD decreases to increase blocking resistance. However, since the CBD is further influenced by the composition and so on of the above-described external additive, these tendencies are not true for all toners.

An appropriate external addition treatment condition to obtain the desired CBD, is such that the peripheral speed of stirring blades is from 25 m/s to 45 m/s, and the external addition treatment time is from 3 minutes to 30 minutes.

4. Toner of the Disclosed Embodiments

The toner of the disclosed embodiments is a toner defined by the conditioned bulk density (CBD). The CBD is a value obtained by a powder flowability analyzing device.

A major cause for toner leakage is that toner accumulation is formed in the vicinity of the sealing part of the developing device, and the toner enters the sealing part concurrently with collapse of the toner accumulation. The stiffness of the toner accumulation in the vicinity of the sealing part (i.e., the hardness of a toner mass) can be replaced by the ease of packing of the conditioned toner in a container with a certain volume (i.e., the CBD). In the disclosed embodiments, therefore, the CBD is used as the index of toner leakage property.

In the case of measuring the CBD of the toner of the disclosed embodiments, prior art literatures relating to powder flowability analyzing devices, etc., can be used as a reference. For example, prior art literatures such as "Powder flowability analyzing device FT4 POWDER RHEOMETER academic materials" (published by Scientific Instrumentation Business Division of Sysmex Corporation, the first edition published on Sep. 1, 2007) (see especially pages 6, 7 and 10) can be used as a reference. However, the CBD used in the disclosed embodiments is not limited to the contents described in the prior patent literatures.

As the powder flowability analyzing device (hereinafter, it may be referred to as "analyzing device"), for example, FT4 POWDER RHEOMETER (product name, manufactured by: Freeman Technology) can be used.

In the disclosed embodiments, conditioning corresponds to a toner packing operation. Accordingly, the conditioned bulk density is a simulated bulk density of the toner that is densely packed in the toner accumulation that is formed at the time of toner development.

A typical example of the conditioning operation is as follows. First, a predetermined amount of sample toner is put in a measurement container. Then, the tip speed of the blades of the analyzing device is set to a predetermined speed, and the entry angle of the blades is set to a predetermined angle. In this state, the conditioning is carried out as follows: the blades are moved from the surface of the toner layer to the inside of the toner layer and then are raised from the inside of the toner layer to the surface of the toner layer. To sufficiently stir the inside of the toner layer, the tip speed and entry angle of the blades may vary depending on the position of the tips of the blades inside the measurement container.

An operation to enter the blades into the toner layer from the toner layer surface and then raise the blades from the toner layer surface, is defined as one cycle. After three cycles of the conditioning operation were carried out, a toner cake layer is produced. The mass of the obtained toner cake layer is divided by the volume of the measurement container, and the resultant is defined as the conditioned bulk density (CBD, g/mL).

The toner of the disclosed embodiments is a toner that the CBD value is from 0.525 g/mL to 0.565 g/mL.

When the CBD is less than 0.525 g/mL, toner leakage occurs. It is thought that this is because the external addition treatment condition is too mild (that is, this is because the peripheral speed of the stirring blades is too slow or the external addition treatment time is too short). As described above, it is thought that toner leakage is caused by poor toner flowability and the resulting toner accumulation. Once the toner is consolidated, it is difficult to fluidize the toner again. Especially, since the toner in the vicinity of the sealing part of the developing device circulates poorly, toner leakage is likely to occur. However, since the toner having an appropriately high CBD can be easily packed at a relatively high density within a constant volume, toner accumulation is less likely to collapse and, as a result, toner leakage is less likely to occur.

On the other hand, when the CBD is more than 0.565 g/mL, the blocking resistance deteriorates. It is thought that this is because, since the external addition treatment condition is too severe (that is, since the peripheral speed of the stirring blades is too fast or the external addition treatment time is too long), the amount of the toner particles that are easily packed at high density increases and, as a result, the toner is likely to aggregate.

The CBD value of the toner of the disclosed embodiments is preferably from 0.527 g/mL to 0.558 g/mL, and more preferably from 0.530 g/mL to 0.555 g/mL.

The BET specific surface area of the toner of the disclosed embodiments is preferably from 1.50 $m^2/g$ to 1.90 $m^2/g$. When the BET specific surface area of the toner is less than 1.50 $m^2/g$, the external additive and so on may penetrate excessively to the inside of the colored resin particles. As a result, the blocking resistance may deteriorate. On the other hand, when the BET specific surface area of the toner is more than 1.90 $m^2/g$, the amount of the external additive and so on released from the surface of the colored resin particles, may be too large. As a result, entry of the toner into the sealing part or a decrease in the strength of a toner dam may be caused, and toner leakage may occur.

The BET specific surface area of the toner is more preferably from 1.55 $m^2/g$ to 1.88 $m^2/g$, and still more preferably from 1.59 $m^2/g$ to 1.86 $m^2/g$.

The BET specific surface area of the toner can be measured by known methods. For example, the BET specific surface area of the toner can be measured by a nitrogen adsorption method (BET method) using a BET specific surface area measuring device (product name: MACSORB HM MODEL-1208, manufactured by: Mountech Co., Ltd.) or the like.

EXAMPLES

Hereinafter, the disclosed embodiments will be described further in detail, with reference to examples and comparative examples. However, the scope of the disclosed embodiments may not be limited to the following examples. Herein, "part(s)" and "%" are based on mass if not particularly mentioned.

Test methods used in the examples and the comparative examples are as follows.

1. Production of Toners for Developing Electrostatic Images

Example 1

First, 77 parts of styrene and 23 parts of n-butyl acrylate as polymerizable monomers and 7 parts of carbon black as a black colorant, were dispersed by means of an in-line type emulsifying and dispersing machine (product name: MILDER, manufactured by: Pacific Machinery & Engineering Co., Ltd.) to obtain a polymerizable monomer mixture.

To the polymerizable monomer mixture, 1.6 parts of a charge control resin (a quaternary ammonium salt copolymer) as a charge control agent, 5 parts of hexaglycerin octabehenate (melting point 70° C.) and 5 parts of paraffin wax (melting point 68° C.) as release agents, 0.3 part of a polymethacrylic acid ester macromonomer (product name: AA6, manufactured by: Toagosei Co., Ltd.) as a macromonomer, 0.6 part of divinylbenzene as a crosslinkable polymerizable monomer, and 1.5 parts of t-dodecyl mercaptan as a molecular weight modifier, were added, mixed and dissolved to prepare a polymerizable monomer composition.

Separately, an aqueous solution of 6.2 parts of sodium hydroxide (alkali metal hydroxide) dissolved in 50 parts of ion-exchanged water, was gradually added to an aqueous solution of 10.2 parts of magnesium chloride (water-soluble polyvalent metal salt) dissolved in 250 parts of ion-exchanged water, while stirring at room temperature, thereby preparing a magnesium hydroxide colloid (hardly water-soluble metal hydroxide colloid) dispersion.

At room temperature, the polymerizable monomer composition was added to the magnesium hydroxide colloid dispersion, and the mixture was stirred. Then, 4.4 parts of t-butylperoxy diethylacetate was added thereto as a polymerization initiator. Then, the mixture was dispersed by high shear stirring at a rotational frequency of 15,000 rpm for 10 minutes, using the in-line type emulsifying and dispersing machine (product name: MILDER, manufactured by: Pacific Machinery & Engineering Co., Ltd.), thereby forming the polymerizable monomer composition into droplets.

The suspension in which the droplets of the polymerizable monomer composition were dispersed (a polymerizable monomer composition dispersion) was put in a reactor furnished with stirring blades, and the temperature thereof was raised to 90° C. to initiate a polymerization reaction. When the polymerization conversion rate reached almost 100%, 2 parts of methyl methacrylate (a polymerizable monomer for shell) and 0.3 part of 2,2'-azobis(2-methyl-N-(2-hydroxyethyl)-propionamide) (a water-soluble polymerization initiator for shell, product name: VA-086, manufactured by: Wako Pure Chemical Industries, Ltd.) dissolved in 10 parts of ion-exchanged water, were added thereto. The reaction was continued for 4 hours at 90° C. and then stopped by water-cooling the reactor, thereby obtaining an aqueous dispersion of colored resin particles having a core-shell structure.

The aqueous dispersion of the colored resin particles was subjected to acid washing in the following manner: while the aqueous dispersion was stirred at room temperature, sulfuric acid was added thereto in a dropwise manner, until the pH of the aqueous dispersion reached 6.5 or less. Then, the aqueous dispersion was subjected to filtration separation, and the thus-obtained solid was re-slurried with 500 parts of ion-exchanged water, and a water washing treatment (washing, filtration and dehydration) was carried out thereon several times. Next, filtration separation was carried out thereon, and the thus-obtained solid was placed in the container of a dryer and dried at 45° C. for 48 hours, thereby obtaining colored resin particles having a volume average particle diameter (Dv) of 7.3 μm, a number average particle diameter (Dn) of 6.7 μm, and a particle size distribution (Dv/Dn) of 1.09.

To 100 parts of the thus-obtained colored resin particles, the following external additives were added: 1.3 parts of silica fine particles having a number average primary particle diameter of 50 nm (product name: H05TA, manufactured by: Clariant Corporation) as inorganic fine particles A; 0.5 part of silica fine particles having a number average primary particle diameter of 20 nm (product name: TG-7120, manufactured by: Cabot Corporation) as inorganic fine particles B; 0.2 part of silica fine particles having a number average primary particle diameter of 7 nm (product name: TG-820F, manufactured by: Cabot Corporation) as inorganic fine particles C; and 0.1 part of zinc stearate fine particles having a number average primary particle diameter of 0.5 μm (product name: SPZ-100F, manufactured by: Sakai Chemical Industry Co., Ltd.) as organic fine particles D. An external addition treatment was carried out by stirring the resulting mixture by means of a laboratory-scale, high-speed stirring device furnished with a cooling jacket (product name: FM MIXER, manufactured by: Nippon Coke & Engineering Co., Ltd., capacity: 10 L) in the condition that the peripheral speed of the stirring blades was 32.2 m/s and the external addition treatment time was 6.0 minutes, thereby producing the toner for developing electrostatic images of Example 1. The test results of the toner are shown in Table 1.

Examples 2 to 10 and Comparative Examples 1 to 4

The toners for developing electrostatic images of Examples 2 to 10 and Comparative Examples 1 to 4, were produced and tested in the same manner as Example 1, except that in the external addition treatment, the amount of the inorganic fine particles A, the amount of the inorganic fine particles B, the peripheral speed of the stirring blades, and the external addition treatment time were changed as shown in the following Table 1.

2. Evaluation of Toners for Developing Electrostatic Images

For the toners for developing electrostatic images of Examples 1 to 10 and Comparative Examples 1 to 4, the properties of the colored resin particles and the properties of the toners were examined. In addition, evaluation of the toners was carried out. The details are as follows.

(1) Properties of Colored Resin Particles and Properties of Toners

A. Volume Average Particle Diameter (Dv), Number Average Particle Diameter (Dn) and Particle Size Distribution (Dv/Dn) of Colored Resin Particles About 0.1 g of a measurement sample (colored resin particles) was weighed out and put in a beaker. Next, as a dispersant, 0.1 mL of an alkylbenzene sulfonic acid aqueous solution (product name: DRIWEL, manufactured by: Fujifilm Corporation) was added thereto. In addition, 10 mL to 30 mL of ISOTON II was put in the beaker. The mixture was dispersed for 3 minutes with a 20 W (watt) ultrasonic disperser. Then, the volume average particle diameter (Dv) and number average particle diameter (Dn) of the colored resin particles were measured with a particle size analyzer (product name: MULTISIZER, manufactured by: Beckman Coulter, Inc.) in the following condition. Also, the particle size distribution (Dv/Dn) was calculated.

Aperture diameter: 100 μm

Medium: ISOTON II

Number of measured particles: 100,000 particles

B. Average Circularity of Colored Resin Particles

First, 10 mL of ion-exchanged water was put in a container. Then, as a dispersant, 0.02 g of a surfactant (alkylbenzene sulfonic acid) was added thereto. In addition, 0.02 g of a measurement sample (colored resin particles) was added thereto. The mixture was subjected to a dispersion treatment for 3 minutes with an ultrasonic disperser at 60 W (watt). The concentration of the colored resin particles was adjusted so as to be from 3,000 to 10,000 particles/μL when measuring. Of the colored resin particles, 1,000 to 10,000 particles having an equivalent circle diameter of 0.4 μm or more were measured with a flow particle image analyzer (product name: FPIA-3000, manufactured by: Sysmex Corporation). From the measured values, the average circularity was obtained.

Circularity is represented by the following calculation formula 1. The average circularity is the average of the calculated circularity values.

(Circularity)=(Perimeter of a circle having the same area as the projected area of a particle image)/(Perimeter of the projected particle image) Calculation Formula 1

C. Coverage

The coverage of the external additive with respect to the colored resin particles, was obtained by the following formula (A):

$$\text{Coverage (\%)} = \frac{\sqrt{3}\, D_N \rho_N X}{2\pi \frac{D_a}{1000} \rho_a} \qquad \text{Formula (A)}$$

where $D_N$ is the particle diameter (μm) of the colored resin particles; $\rho_N$ is the density of the colored resin particles; $D_a$ is the particle diameter (nm) of the external additive; $\rho_a$ is the density of the external additive; and X is the content (% by mass) of the external additive.

As used herein, in the formula (A), the number average particle diameter (Dn) of the colored resin particles was plugged in for $D_N$; the number average primary particle diameter of each external additive was plugged in for $D_a$; the density value obtained from the number average particle diameter (Dn) and mass of the colored resin particles was plugged in for $\rho_N$; the density value obtained from the number average primary particle diameter and mass of the external additive was plugged in for $\rho_a$. Also, the content of each external additive with respect to 100 parts by mass of the colored resin particles, was converted into the content (% by mass) of the external additive and plugged in for X in the formula (A).

For each of the inorganic fine particles A to D, the coverage was calculated by the formula (A). The sum of the thus-obtained coverages was defined as the coverage of the external additive of the toner.

D. Conditioned Bulk Density (CBD) of Toners

The following measurement was carried out by means of a powder flowability analyzing device (product name: FT4 POWDER RHEOMETER, manufactured by: Freeman Technology).

Each toner was conditioned as follows. A measurement container (inner diameter: 50 mm, volume: 160 mL) furnished with a clamp was connected to an ancillary container (inner diameter: 50 mm, volume: 85 mL) by a splitter. About 100 g of the toner subject to evaluation, was packed in the connected container and left to stand for 10 minutes as it was. The packed toner amount was slightly larger than the capacity of the measurement container. The ancillary container was placed on the top of the measurement container and connected thereto. The total height of the measurement container and the ancillary container was 140 mm. When "a position . . . mm above the bottom of the measurement container" appears in the following descriptions, the ancillary container is deemed as a part of the measurement container.

Next, the measurement container was installed in an analyzing device furnished with propeller type blades. The blades were entered into the toner layer from the surface of the toner layer. With stirring the toner, the blades were vertically moved down until it reached a position 10 mm above the bottom of the measurement container. At that time, the tip speed and entry angle of the blades were set to the following speed and angle. The entry angle of the blades is an angle made by the meeting of the toner layer surface with a spiral path drawn by the blades.

Tip speed of the blades: 60 mm/sec

Entry angle of the blades: 5° in clockwise direction

Then, the entry angle of the blades was changed to 2° in clockwise direction, without changing the tip speed of the blades. In this state, while stirring the toner, the blades were moved down to a position 1 mm above the bottom of the measurement container.

Next, the entry angle of the blades was changed to 5° in anticlockwise direction, without changing the tip speed of the blades. While stirring the toner, the blades were moved up to a position 100 mm above the bottom of the measurement container. Then, the blades were raised from the toner layer surface.

The blades raised from the toner layer surface, were quickly and alternately rotated in clockwise and anticlockwise directions, thereby shaking excess toner off the blades.

An operation to enter the blades into the toner layer from the toner layer surface and then raise the blades from the toner layer surface, was defined as one cycle of the conditioning operation.

After three cycles of the conditioning operation were carried out, in order to adjust the amount of the toner subject to evaluation, the toner was leveled off using the splitter so that the toner was packed in the measurement container only, thereby producing a toner cake layer having an approximately equal volume to the measurement container.

The mass of the toner cake layer was divided by the volume of the measurement container. The thus-obtained value was defined as conditioned bulk density (CBD, g/mL).

E. Measurement of BET Specific Surface Area

For each toner, the BET specific surface area was measured by a nitrogen adsorption method (BET method) using an automatic BET specific surface area measuring device (product name: MACSORB HM MODEL-1208, manufactured by: Mountech Co., Ltd.)

(2) Evaluation of Toners

A. Toner Leakage Test

A commercially-available, non-magnetic one-component development printer was modified and used in the toner leakage test. First, the toner was packed in the toner cartridge of the printer. Then, the toner cartridge was left to stand under a high temperature and high humidity (H/H) environment (temperature: 32.5° C., humidity: 80%) for 24 hours. Next, under the same environment, the toner cartridge was installed in the printer. An operation to run the printer for 10 seconds and then stop the printer for 10 seconds, was repeated for 16 hours. During the operation, sealing parts between the casing of the developing cartridge and both of the axial ends of the developing roller, was observed every two hours to check the presence of toner leakage.

The same test was carried out three times, and the average of the time during which toner leakage was observed (i.e., the average toner leakage time) was defined as the index of leakage property. As the average toner leakage time increases, it means that the toner becomes less likely to leak.

B. Blocking Test

First, 20 g of the toner was put in a container, and the container was hermetically closed. The hermetically closed container was immersed in a thermostat bath at a predetermined temperature (55° C., 56° C. or 57° C.) for 8 hours and then removed from the thermostat bath. The toner was transferred from the container onto a 42-mesh screen, without causing vibration to the toner as much as possible, and the screen was installed in a powder measuring device (product name: POWDER CHARACTERISTICS TESTER PT-R, manufactured by: Hosokawa Micron Corporation). With an amplitude of 1.0 mm, the screen was oscillated for 30 seconds. The mass of the toner remaining on the screen was measured and defined as aggregated toner amount (g). As the aggregated toner amount decreases, it means that the toner is less aggregated and has better storage stability.

The following Table 1 shows the measurement and evaluation results of the toners for developing electrostatic images of Examples 1 to 10 and Comparative Examples 1 to 4, along with the external addition treatment condition. In the following Table 1, ">16" means that even though the toner leakage test was carried out three times, no toner leakage was observed in the test time (16 hours).

TABLE 1

| | | Example 1 | Example 2 | Example 3 | Example 4 | Example 5 | Example 6 | Example 7 | Example 8 |
|---|---|---|---|---|---|---|---|---|---|
| External addition treatment condition | Added amount (part) of inorganic fine particles A | 1.3 | 1.2 | 1 | 1.3 | 1.2 | 0.8 | 1.2 | 0.7 |
| | Added amount (part) of inorganic fine particles B | 0.5 | 0.5 | 0.8 | 0.5 | 0.5 | 0.7 | 0.5 | 0.6 |
| | Peripheral speed (m/s) of stirring blades | 32.2 | 35.7 | 28.7 | 33.6 | 36 | 36 | 38 | 44.9 |
| | External addition treatment time (min) | 6 | 6 | 6 | 9 | 12 | 12 | 9 | 12 |
| Properties of toner, etc. | Dv (μm) | 7.3 | 7.7 | 7.7 | 7.3 | 7.7 | 7.7 | 7.7 | 7.6 |
| | Average circularity | 0.983 | 0.985 | 0.985 | 0.983 | 0.985 | 0.985 | 0.985 | 0.985 |
| | Coverage (%) | 69 | 69 | 77.7 | 69 | 69 | 69 | 69 | 69 |
| | CBD (g/mL) | 0.533 | 0.533 | 0.541 | 0.534 | 0.551 | 0.555 | 0.536 | 0.559 |
| | BET specific surface area ($m^2$/kg) | 1.86 | 1.75 | 1.91 | 1.85 | 1.59 | 1.64 | 1.74 | 1.47 |
| Toner evaluation | Average toner leakage time (h) | >16 | >16 | >16 | >16 | >16 | >16 | >16 | >16 |
| | Aggregated toner amount (g) 55° C. | 0.2 | 0.2 | 0.2 | 0.2 | 0.2 | 0.2 | 0.2 | 0.2 |
| | Aggregated toner amount (g) 56° C. | 0.2 | 0.2 | 0.2 | 0.2 | 0.4 | 0.9 | 0.2 | 10 |
| | Aggregated toner amount (g) 57° C. | 0.2 | 0.1 | 0.2 | 0.2 | 10 | 11 | 0.1 | 16 |

| | | Example 9 | Example 10 | Comparative Example 1 | Comparative Example 2 | Comparative Example 3 | Comparative Example 4 |
|---|---|---|---|---|---|---|---|
| External addition treatment condition | Added amount (part) of inorganic fine particles A | 0.7 | 1 | 1.3 | 1.3 | 1 | 1 |
| | Added amount (part) of inorganic fine particles B | 0.6 | 0.8 | 0.5 | 0.5 | 0.8 | 0.8 |
| | Peripheral speed (m/s) of stirring blades | 36 | 36 | 28.7 | 23.1 | 49.5 | 44 |
| | External addition treatment time (min) | 12 | 12 | 6 | 6 | 120 | 25 |
| Properties of toner, etc. | Dv (μm) | 7.7 | 7.7 | 7.4 | 7.3 | 7.6 | 7.8 |
| | Average circularity | 0.985 | 0.985 | 0.983 | 0.983 | 0.985 | 0.987 |
| | Coverage (%) | 60 | 77.7 | 69 | 69 | 77.7 | 77.7 |
| | CBD (g/mL) | 0.556 | 0.562 | 0.523 | 0.517 | 0.595 | 0.573 |
| | BET specific surface area ($m^2$/kg) | 1.55 | 1.7 | 1.86 | 2 | 0.85 | 1.54 |
| Toner evaluation | Average toner leakage time (h) | >16 | 16 | 10 | 4 | >16 | >16 |
| | Aggregated toner amount (g) 55° C. | 0.2 | 0.2 | 0.2 | 0.2 | 11 | 2 |
| | Aggregated toner amount (g) 56° C. | 9 | 0.2 | 0.2 | 0.2 | 15 | 11 |
| | Aggregated toner amount (g) 57° C. | 15 | 4 | 0.2 | 0.2 | 16 | 16 |

3. Discussion of Toners

Hereinafter, the evaluation results of the toners for developing electrostatic images will be discussed with reference to Table 1.

According to Table 1, the toner of Comparative Example 1 is a toner having a CBD of 0.523 g/mL. The toner of Comparative Example 2 is a toner having a CBD of 0.517 g/mL.

According to Table 1, for the toners of Comparative Examples 1 and 2, their aggregated toner amounts in a range of from 55° C. to 57° C., are all 0.2 g. Therefore, these toners do not have a problem with at least high temperature storage stability.

However, for the toner of Comparative Example 1, the average toner leakage time is 10 hours. For the toner of Comparative Example 2, the average toner leakage time is 4 hours. Therefore, it was revealed that both of the toners of Comparative Examples 1 and 2, each having a CBD of less than 0.525 g/mL, are likely to leak.

According to Table 1, the toner of Comparative Example 3 is a toner having a CBD of 0.595 g/mL. The toner of Comparative Example 4 is a toner having a CBD of 0.573 g/mL.

According to Table 1, for the toners of Comparative Examples 3 and 4, their aggregated toner amounts at 55° C. are both 2 g or more, and their aggregated toner amounts at 56° C. and 57° C. are all 11 g or more. Therefore, it was revealed that the toners of Comparative Examples 3 and 4, each having a CBD of more than 0.565 g/mL, are poor in high temperature storage stability.

Meanwhile, according to Table 1, the toners of Examples 1 to 10 are toners having a CBD in a range of from 0.533 to 0.562. According to Table 1, for the toners of Examples 1 to 10, their average toner leakage times are 16 hours or more; their aggregated toner amounts at 55° C. are all 0.2 g; their aggregated toner amounts at 56° C. are 10 g or less; and their aggregated toner amounts at 57° C. are 16 g or less.

Therefore, it was revealed that the toners of Examples 1 to 10 having a CBD in a range of from 0.525 g/mL to 0.565 g/mL, are toners which are less likely to cause toner leakage and which are less likely to cause toner aggregation after being left to stand under a high temperature condition.

Hereinafter, the influence of the external addition treatment condition on the CBD and the toner properties, will be discussed.

First, Example 1 (peripheral speed: 32.2 m/s), Comparative Example 1 (peripheral speed: 28.7 m/s) and Comparative Example 2 (peripheral speed: 23.1 m/s) will be compared, which are different in the peripheral speed condition of the stirring blades. The CBD value increases in the following order: Comparative Example 2<Comparative Example 1<Example 1. The average toner leakage time increases in the following order: Comparative Example 2<Comparative Example 1<Example 1. From these results, it is presumed that by increasing the peripheral speed of the stirring blades, the CBD value is increased, and the possibility of toner leakage can be reduced.

Next, Example 2 (external addition treatment time: 6 minutes) and Example 5 (external addition treatment time: 12 minutes) will be compared, which are different in the external addition treatment time. Their external addition treatment conditions are almost the same, except the external addition treatment time. The external addition treatment time increases in the following order: Example 2<Example 5. The CBD increases in the following order: Example 2<Example 5. The aggregated toner amount of Example 5 is larger than that of Example 2, especially in the high temperature range. From these results, it is presumed that as the external addition treatment time increases, the CBD value increases and, meanwhile, the blocking resistance slightly decreases.

Hereinafter, the influence of the content of the external additive, etc., on the toner properties, will be discussed.

First, Example 5 (inorganic fine particles A: 1.2 parts, inorganic fine particles B: 0.5 part) and Example 6 (inorganic fine particles A: 0.8 part, inorganic fine particles B: 0.7 part) will be compared, which are only different in the compositions of the inorganic fine particles A and B.

According to Table 1, both of the toners of Examples 5 and 6 do not have a toner leakage problem. For the toner of Example 6, the aggregated toner amount under the high temperature condition is slightly large compared to the toner of Example 5. The CBD of Example 6 is larger than the CBD of Example 5.

From the above results, it can be said that in the case where the content of the inorganic fine particles A is more than twice the content of the inorganic fine particles B (Example 5), the storage stability under the high temperature condition tends to be slightly better than the case where the content of the inorganic fine particles A is the same level as the content of the inorganic fine particles B (Example 6). This is because the inorganic fine particles A having a large particle diameter largely contribute to an increase in storage stability. On the other hand, since the inorganic fine particles A contribute less to toner flowability than the inorganic fine particles B, it is presumed that the CBD tends to decrease as the content of the inorganic fine particles A increases.

Next, Example 6 (inorganic fine particles A: 0.8 part, inorganic fine particles B: 0.7 part, coverage: 69.0%), Example 9 (inorganic fine particles A: 0.7 part, inorganic fine particles B: 0.6 part, coverage: 60.0%) and Example 10 (inorganic fine particles A: 1.0 part, inorganic fine particles B: 0.8 part, coverage: 77.7%) will be compared, which are different in the composition of the inorganic fine particles A and B and in the coverage.

According to Table 1, all of the toners of Examples 6, 9 and 10 do not have a toner leakage problem. The aggregated toner amount in the higher temperature condition (56° C. and 57° C.) increases in the following order: Example 10<Example 6<Example 9. The coverage increases in the following order: Example 9<Example 6<Example 10. Also, the CBD value increases in the following order: Example 6<Example 9<Example 10.

From the above results, in the case where the content of the inorganic fine particles A is the same level as the content of the inorganic fine particles B (Examples 6, 9 and 10), it can be said that the high temperature storage stability tends to increase as the coverage increases. The coverage tends to increase as the total content of the external additive increases. Therefore, it can be said that in order to increase the high temperature storage stability, the added amount of the external additive needs to be increased.

The invention claimed is:

1. A toner for developing electrostatic images, comprising colored resin particles comprising a binder resin and a colorant, and an external additive, wherein the external additive contains:

silica fine particles having a number average primary particle diameter of from 36 nm to 100 nm as inorganic fine particles A, silica fine particles having a number average primary particle diameter of from 15 nm to 35 nm as inorganic fine particles B, and zinc stearate fine particles having a number average primary particle diameter of from 0.3 μm to 2.0 μm as organic fine particles D, and wherein the content of the inorganic fine particles A is from 0.3 part by mass to 2.0 parts by mass with respect to 100 parts by mass of the colored resin particles, and the content of the inorganic fine particles B is from 0.3 part by mass to 1.0 part by mass with respect to 100 parts by mass of the colored resin particles, and wherein a conditioned bulk density defined as a value of a mass of a toner cake layer divided by a volume of a measurement container, wherein the toner cake is obtained by leveling off the toner using a splitter to be packed in the measurement container only, after carrying out three cycles of a conditioning operation by means of a powder flowability analyzing device is from 0.525 g/mL to 0.565 g/mL, the conditioning operation comprising:

a first step of packing 100 g of the toner in a measurement container with an inner diameter of 50 mm and a total height of 140 mm, and leaving the toner to stand for ten minutes to form a toner layer;

a second step of setting a tip speed of blades of an analyzing device to 60 mm/sec while setting an entry angle of the blades to 5° in clockwise direction, wherein in this state, with stirring the toner layer, the blades are moved from a surface of a toner layer to an inside of the toner layer until reaching a position 10 mm above a bottom of the measurement container;

a third step of changing the entry angle of the blades to 2° in clockwise direction without changing the tip speed of the blades, wherein in this state, while stirring the toner layer, the blades are moved down to a position 1 mm above the bottom of the measurement container;

a fourth step of changing the entry angle of the blades to 5° in anticlockwise direction without changing the tip speed of the blades, wherein while stirring the toner, the blades are moved up to a position 100 mm above the bottom of the measurement container; and a fifth step of raising the blades from a toner layer surface, wherein a sequence from the second step to the fifth step is defined as one cycle.

2. The toner for developing electrostatic images according to claim 1, wherein a BET specific surface area of the toner for developing electrostatic images is from 1.50 $m^2/g$ to 1.90 $m^2/g$.

3. The toner for developing electrostatic images according to claim 1, wherein an average circularity of the toner for developing electrostatic images is from 0.96 to 1.00.

4. The toner for developing electrostatic images according to claim 1, wherein a volume average particle diameter (Dv) of the colored resin particles is from 4 μm to 12 μm.

* * * * *